United States Patent [19]

Berman

[11] 4,091,233

[45] May 23, 1978

[54] ELECTRICAL CONNECTOR AND METHOD OF CONNECTING AN ELECTRICAL CABLE TO SAME

[76] Inventor: Alfred J. Berman, 5715 Kelvin Ave., Woodland Hills, Los Angeles, Calif. 91364

[21] Appl. No.: 716,791

[22] Filed: Aug. 23, 1976

[51] Int. Cl.[2] ..... H01R 5/02; H01R 13/38; H01R 9/08

[52] U.S. Cl. ..... 174/88 R; 29/628; 174/92; 339/100

[58] Field of Search ..... 174/75 R, 76, 84 R, 174/84 S, 88 R, 88 S, 90, 92, 93; 339/96, 100, 208; 29/628

[56] References Cited

U.S. PATENT DOCUMENTS

| | | | |
|---|---|---|---|
| 3,175,176 | 3/1965 | Henschke | 339/100 X |
| 3,317,883 | 5/1967 | Gourley et al. | 339/100 X |
| 3,550,765 | 12/1970 | Anderson | 174/87 X |
| 3,951,503 | 4/1976 | Caulkins | 174/88 R X |
| 4,013,333 | 3/1977 | Chang | 339/100 X |

*Primary Examiner*—Laramie E. Askin

*Attorney, Agent, or Firm*—Robert M. Ashen

[57] ABSTRACT

A connector for electrically and physically connecting to one or more insulated electrical cords or cables. The illustrated connector comprises a housing made of electrical insulating material and defining at least one receptacle in which are disposed one or more prongs of electrically conductive material. The receptacle and the prong therein are proportioned and arranged to receive one end of an electrical cord. The cord is inserted into the receptacle so that each prong extends into the end of the cord so as to make physical and electrical contact with a wire of the cord. There is also provided in each receptacle a contained portion of adhesive material which may be readily released from its container to create a physical bond between the cord and the connector. In one illustrated form the connector provides a pair of opposed receptacles for connecting together the ends of two electrical cords, each cord containing a pair of electrical wires. The connector may take other forms such as a switch or a male electrical connector which is connected to the end of a cord.

12 Claims, 9 Drawing Figures

ELECTRICAL CONNECTOR AND METHOD OF CONNECTING AN ELECTRICAL CABLE TO SAME

There is a need for a simple and effective electrical cable connector which permits one to quickly, effectively and simply connect to the end of an electrical cable having one or more wires or strands extending therethrough, with the connection being relatively permanent and without requiring tools or preparation of the cable for the connection.

In this connection, there have been electrical wire connectors as exemplified by the U.S. Pat. No. 2,353,232 to Kingsley, which shows an electrical wire connector having a single prong or needle extending in each direction. The needles are disposed within a tubular housing and the end of a single wire electrical cable can be inserted into either end of that connector to establish an electrical connection between the wires of the two cables. The cables are mechanically intertwined and then held by secondary sections of the connector housing to prevent them from disconnecting. Such arrangement is rather cumbersome and unsightly. It could also offer the temptation and opportunity to a child to disconnect the connected wires and thereby injure himself.

There have been other electrical connectors where the ends of the wires themselves have been used to pierce an adhesive capsule or container. For example, the Rice, U.S. Pat. No. 3,385,922, shows an electrical connector where the ends of two wires are pierced through several adjacent pockets of adhesive material. The Bird, U.S. Pat. No. 3,083,260, shows an adhesive connecting together a pair of wires which have been twisted together and are then themselves forced through a seal into a cup with adhesive material. For such applications where the wires themselves pierce the container for the adhesive, it is necessary to prepare or strip back the wires and the effectiveness of such devices appears questionable, particularly where the wire is made up of a group of twisted strands and/or where the wire is relatively soft material so that there may be problems in effectively piercing the adhesive containers. Further, such devices appear limited to connecting a single pair of wires.

Thus, the various prior art devices involve a variety of limitations and drawbacks.

The electrical cable connector contemplated by the present invention provides a simple, quick and effective device for automatically, electrically and physically creating a relatively permanent inter-connection between the connector and one or more wires contained in electrical cables. By the provision of prongs which are imbedded into the ends of the cable and make physical and electrical contact with the wire of the cable, it is not necessary to prepare or strip the cable or to have other tools to prepare the cable for the connection. Further, by the provision of adhesive material which is readily released incident to the connection of the connector to the cable, a relatively permanent inter-connection is created to maintain the cable in its desired relationship with the connector. The resultant structure is essentially a continuation with only slight enlargement of the size of the cable to which it is connected. The device may be utilized for single wire cables or for multiple wire cables it may be used to inter-connect the ends of two cables, it may be used to place a switch or other mechanism into a mid-point of a cable or line, or it may be used to connect an electrical element such as a male plug to the end of a cable.

IN THE DRAWINGS

Figure 9:
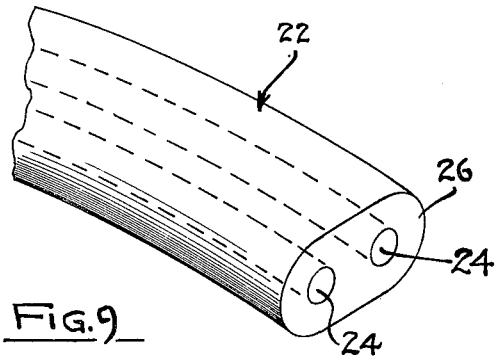
FIG. 9 is a perspective view of an end portion of one electrical cable which may be connected to by the connectors illustrated in FIGS. 1–7.

FIGS. 1 to 4 show a presently preferred form of electrical cable connector 10 which embodies the present invention. In general, connector 10 comprises a generally tubular housing 12 which is open at either end and has a transverse center section 14 so as to define a receptacle 16 facing in either direction. Mounted at the center section are a pair of electrical conductor elements 18 which each include a pair of pointed prongs 20. The prongs 20 of each electrical conductor element 18 extend in opposite directions of the housing center section 14 and into the opposed receptacles 16. Thus, there is provided a pair of spaced apart prongs 20 extending into each of the receptacles 16. The illustrated connector is adapted to electrically and mechanically connect to a two-wire electrical cable of the type shown in FIG. 9. The cable designated generally 22 includes insulation and a pair of wires 24. The end 26 of the cable 22 may be inserted into one receptacle 16 while the end of a like cable may be inserted into the other receptacle. When the cable 22 is so inserted in a receptacle, each prong 20 pierces the end of the cable 22 so as to make physical and electrical contact with a wire 24.

For purposes of securing the cable ends in the receptacles 16 of the connector 10, an envelope 32 of flowable adhesive material 34 is provided at the entrance of each of the receptacles. The envelope 32 may conform to the general oval configuration of the entrance to the receptacle 16 and be mounted at that entrance as by means of a peripheral lip 44 which is received and secured in a mating recess 50 which extends around the mouth of each of the receptacles 16. The envelope 32 may be secured in place by suitable means such as adhesive, a chemical solvent, tack welding or the like. When the end of the cable 22 is inserted into a receptacle 16, the envelope 32 at the mouth or entrance to that receptacle is thereby physically burst and the flowable adhesive material 34 in the envelope is released into the receptacle to then create a bond between the end of the cable 22 and the connector housing. This bursting of the envelope is achieved by forcing the envelope against the prongs and thereby causing the prongs to pierce the envelope.

Now considering the illustrated connector 10 in further detail, the housing may be constructed of various suitable insulating materials as for example, molded polycarbonate, which is a good electrical insulator. An example of such material is sold by G.E. under the trademark "Lexion."

The center section 14 of the housing supports the electrical conductor elements 18 which provide the prongs 20. The illustrated electrical conductor elements 18 each comprise a pair of oppositely directed prongs 20 and a center section 42 which is illustrated in the form of a flat circular disc or cylinder. The housing may be molded or formed with the electrical conductor elements in place as illustrated in the drawings of FIGS. 1 to 4. Alternatively, the housing may be formed with recesses into which the electrical conductor elements may be inserted separately as by means of a snap fit (not shown in the drawings). The electrical conductor elements may be of any suitable electrically conductive material such as various electrically conductive metals. Brass has been found to be a good material for this application.

The illustrated adhesive for bonding the cable end in a receptacle is illustrated in the form of the adhesive envelope 32 which is secured at the entrance to the receptacle. Each envelope 32 may contain a quantity of a fluid or liquid adhesive 34 such as material imported from Japan and known as "crazy glue," or similar adhesive such as those sold under the trademark "Eastman 9-10" or "Locktite." The envelope 32 may be constructed of a readily breakable or fracturable plastic film such as polystyrene or a PVC or acrylate. The adhesive is of the type which will solidify at room temperatures when it is exposed to the air and a bond will thereby be created between the cable in the receptacle and the connector.

Alternatively, the envelope 32 of adhesive 34 may be provided to the user separate from the housing, for insertion by the user into a receptacle 16 prior to inserting the cable end. The insertion of the cable end would force the envelope against the prongs 20 and thereby pierce the envelope and release the adhesive. Such a separate envelope of adhesive is illustrated at 32' in broken line in FIG. 2 disposed in a receptacle adjacent to a prong 20.

The connector 10 is particularly useful for application where there is a constant uniform size and configuration of cable being connected to so that the end of the cable will conform generally to the inner configuration of the receptacle and properly align the wire or wires of the cable with the prongs for good electrical connection therebetween.

Figure 1:
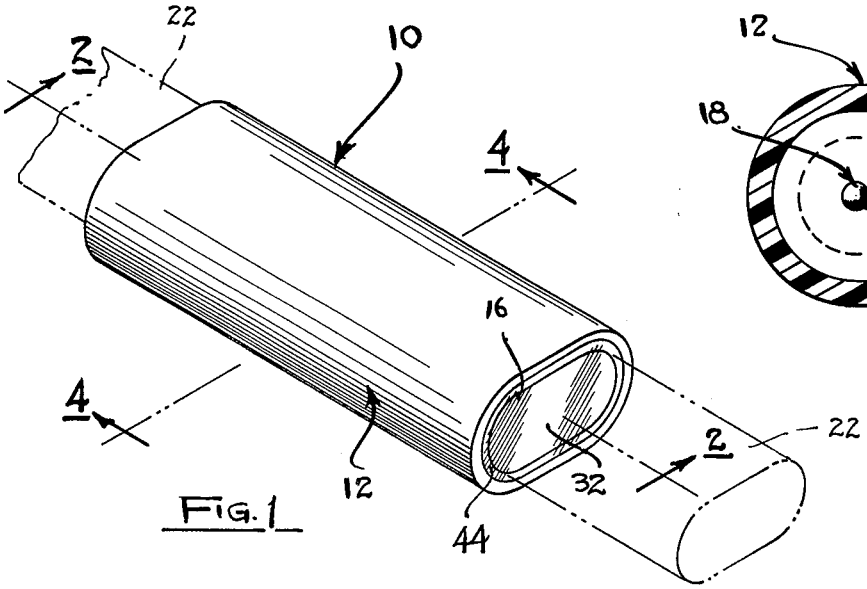
FIG. 1 is a perspective view of a presently preferred form of electrical cable connector embodying the present invention.
Figure 4:
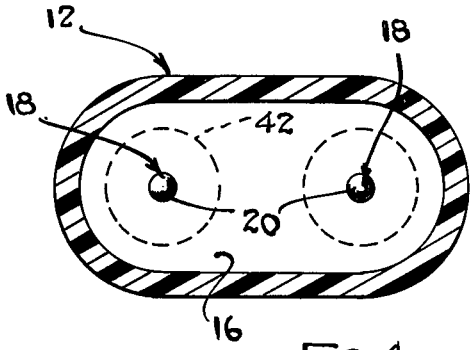
FIG. 4 is a transverse sectional view taken generally along line 4—4 of FIG. 1.
Figure 2:
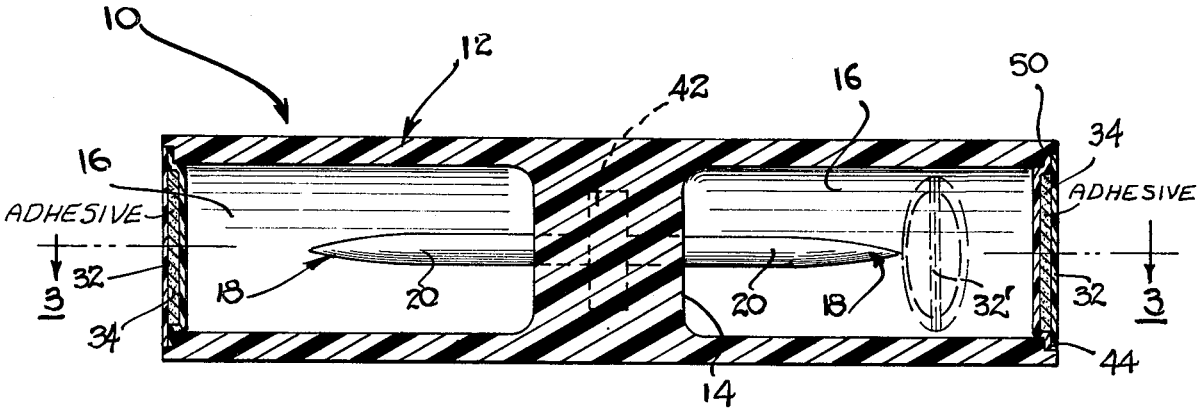
FIG. 2 is an enlarged sectional view taken generally along line 2—2 of FIG. 1.
Figure 3:
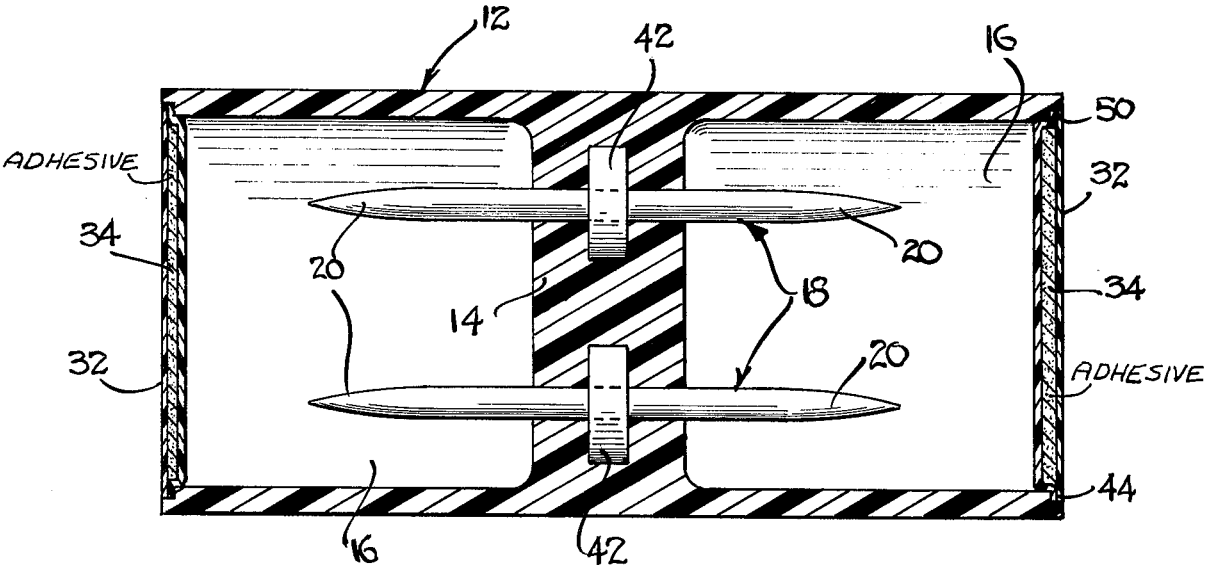
FIG. 3 is a sectional view taken generally along line 3—3 of FIG. 2.
Figure 5:
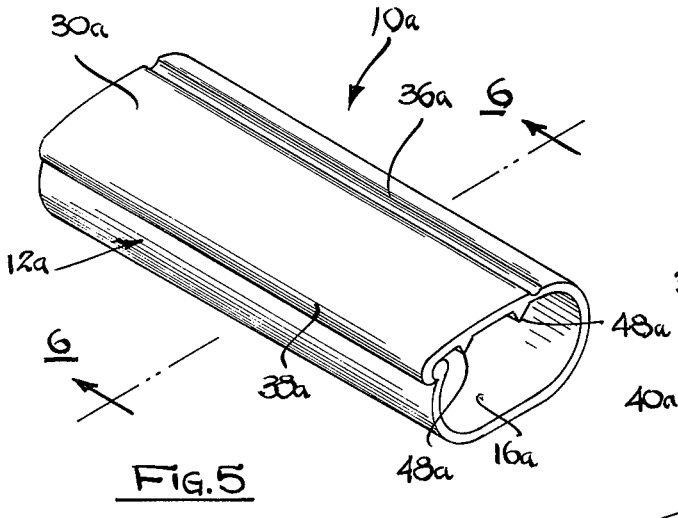
FIG. 5 is a perspective view of a modified form of the electrical cable connector.
Figure 6:
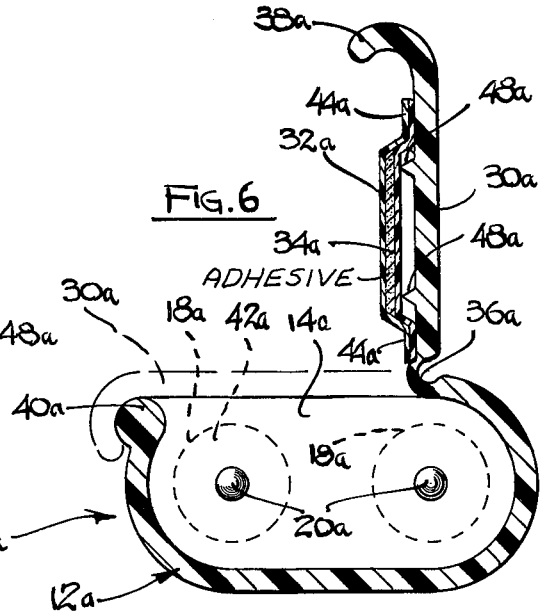
FIG. 6 is an enlarged sectional view taken generally along line 6—6 of FIG. 5 showing the lid for the connector in its open position in solid lines and showing the lid in a closed position in broken lines.
Figure 7:
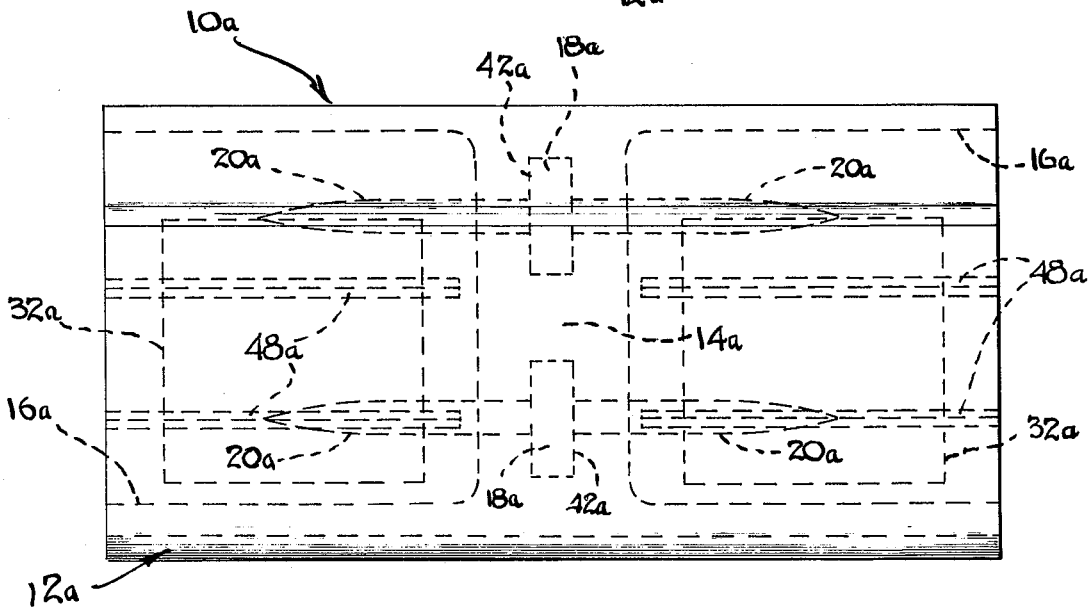
FIG. 7 is an enlarged top plan view of the connector of FIGS. 5 and 6.

FIGS. 5 through 7 show a modified form of connector embodying the present invention. The connector **10*a* comprises a generally tubular housing 12*a* which is open at either end and has a central portion 14*a* dividing the interior of the housing into a pair of oppositely facing receptacles 16*a*. A pair of electrically conductive elements 18*a* which each include a pair of oppositely facing prongs 20*a* are mounted in the housing with the prongs extending into opposite receptacles. The electrically conductive elements 18*a* include center sections 42*a* which may be molded in place in the center section 14*a* of the housing. The end of an electrical cable such as cable 22 shown in FIG. 9 may be inserted into each receptacle 16*a* of the connector 10*a* with the prongs 20*a* inserting into the end of the cable and making physical and electrical contact with the respective wires 24 of the cable 22**.

As shown best in FIG. 6, the housing **12*a* is constructed with a lid 30*a* which may be opened to permit installation of the cable ends in the receptacle and which then may be closed to the position shown in broken line in FIG. 6. The lid 30*a* carries a pair of containers 32*a* of adhesive material 34*a*. The connector is so constructed that when the lid 30*a* is closed with the cables inserted in the receptacles, the containers 32*a* for the adhesive are broken, permitting the adhesive material to flow out and create a bond between the connector housing and the cable end disposed in the adjacent receptacles. As shown in FIG. 7, there is an adhesive container 32*a* associated with each of the receptacles 16*a***.

Illustrated lid **30*a* extends the length of the housing and is connected to the remainder of the housing by an integrally formed, reduced cross-section hinge portion 36*a*. The lid also has a curved latching lip 38*a* adapted to form a snap fit when closed over a bead 40*a* of the housing. Thus, the housing may be molded in the configuration shown in solid line FIG. 6; that is, with the lid open. This permits ready visual access to the receptacle for assuring that the electrical cables are properly aligned and that the prongs make good electrical contact with the wires of the cable when the cable is inserted into each receptacle. After the cables are securely in place in the receptacles and upon the prongs, the lid can be lowered to the position shown in broken lines in FIG. 6 and snapped shut over the bead 40*a***. The open lid also permits the connector to accommodate some variations in size or dimension of cable or the positioning or spacing of the wire within the cable by visually aligning the ends of the cable with the prongs.

Each illustrated container or envelope **32*a* is generally flat and has a pair of opposed edges or margin portions 44*a* by which it may be readily secured to the underside of the lid 30*a*** as by means of adhesive, heat tack welding or the like.

Means in the form of longitudinally extending projections **48*a* are provided on the underside of the lid 30*a* behind each of the adhesive envelopes 32*a* for the purpose of causing fracture of the envelope when the lid is closed. As can be visualized by looking at FIG. 6, with a cable 22 inserted in the receptacle of the connector and thereby occupying that receptacle, the closing of the lid 30*a* will cause the envelope 32*a* to be caught between the pointed edge of the projection 48*a* and the adjacent portion of the cable to cause the envelope 32*a* to burst and permit the adhesive 34*a*** to flow out into the area between the lid and the cable.

Figure 8:
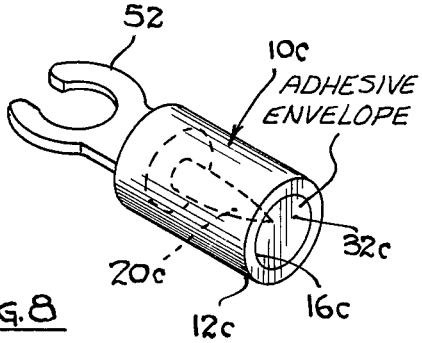
FIG. 8 is a perspective view of another form of electrical cable connector.

The connector of the invention may take various other forms as for example, it may take the form of a male connector which goes into a wall plug. This male wall plug connector would connect to one end of a two-wire or two-lead cable or cord. The connector may also take the form of a switch which is inserted in a line and which connects to the ends of a pair of electrical cables or cords. FIG. 8 illustrates another form of the connector designated **10*c*. Connector 10*c* has a generally cylindrical housing 12*c* defining a receptacle 16*c* in which a single prong 20*c* of electrically conductive material is disposed. The prong 20*c* is electrically connected to or integrally formed with an electrical connector tab 52 of the type used to create connections between speakers, amplifiers and similar types of high fidelity electronic equipment. The connector 10*c* also has an adhesive envelope 32c disposed at the entrance to the receptacle 16c so that when the end of an electrical cable is inserted into the receptacle 16c the envelope 32c is broken and flowable adhesive material is released to subsequently solidify and create a bond between the end of the electrical cable and the connector 10c. Thus, connector 10c** is connected to the end of a single wire cable or cord.

Other modifications and changes may be made in the illustrated structure without departing from the spirit and scope of the present invention as set forth in the appended claims.

I claim:

1. A compact electrical connector for quickly and easily connecting to one another in linear alignment the ends of a pair of electrical cables each having at least one wire extending therethrough, said connector comprising:

(a) a housing of electrical insulating material defining a pair of elongated receptacles, each of said receptacles having an entrance and peripheral walls and being configured and proportioned for receipt therein of the end of an electrical cable having exterior insulation and at least one electrical wire extending therethrough, said receptacles being generally aligned in end-to-end relation to one another with their respective entrances opening in opposite directions, said housing having an exterior surface which is not substantially larger in transverse cross-section than the transverse cross-section of the exterior surface of the cables;

(b) at least one prong of electrically conductive material disposed within each of said receptacles, said prongs being electrically connected to one another, each of said prongs being elongated and having a pointed end, each of said prongs extending generally longitudinally of its associated receptacle with said pointed end facing the entrance into the associated receptacle; each of said prongs being disposed generally intermediate the peripheral walls of its associated receptacle so as to be aligned with the wire in the associated electrical cable when that electrical cable is inserted into the associated receptacle, whereby each of said prongs is imbedded into the associated cable when that cable is inserted into the associated receptacle to thereby establish physical and electrical connection between the wires of the cables and the respective prongs, (c) adhesive means disposed within each said receptacle for bonding the associated cable end to the housing, each said adhesive means comprising a quantity of flowable adhesive material enclosed within a fracturable container for ready release when the associated cable end is disposed in the associated receptacle, whereby said adhesive will form a bond, when it solidifies, between the insulating material of the associated cable and the housing of the connector.

2. The connector of claim 1 wherein, for each receptacle, said adhesive means is located outwardly of said pointed prong end and is forced against said pointed prong end by the insertion of a cable end into the receptacle so as to cause rupture of said adhesive container incident to insertion of the cable end into the receptacle.

3. The connector of claim 2 wherein each of said adhesive containers is secured at the entrance to one of said receptacles.

4. The connector of claim 2 wherein each of said adhesive containers is a separate unit for being manually disposed in one of said receptacles prior to the insertion of a cable end into the receptacle.

5. The connector as set forth in claim 1 wherein each of said containers comprises a thin film of fracturable material and said adhesive material is a flowable liquid adhesive material.

6. The connector of claim 1 wherein there are two prongs in each of said receptacles, each of the prongs in one of the receptacles being electrically connected to a respective one of the prongs in the other of said receptacles.

7. The connector of claim 1 wherein said prongs are electrically connected by virtue of being composed of a single metal piece.

8. The connector of claim 7 wherein said metal piece comprises an enlarged intermediate section and said housing comprises an intermediate wall section in which said enlarged intermediate section of the metal piece is located.

9. The connector of claim 8 wherein said intermediate wall section is molded around said enlarged intermediate section of said metal piece.

10. The connector of claim 8 wherein said intermediate wall section is first formed with a recess and said enlarged intermediate section of said metal piece is then assembled into said recess.

11. A method for connecting together in linear alignment a pair of electrical cables which each have at least one wire extending therethrough by the use of a compact electrical connector, said method comprising the steps of:

(a) providing an electrical connector having a housing of electrical insulating material defining a pair of elongated receptacles, each of said receptacles having an entrance and peripheral walls and being configured and proportioned for receipt therein of the end of an electrical cable which has exterior insulation and at least one electrical wire extending therethrough; said receptacles being generally aligned in end-to-end relation to one another with their respective entrances opening in opposite directions, said housing having an exterior surface which is not substantially larger in transverse cross-section than the transverse cross-section of the exterior surface of the cables; there being at least one prong of electrically conductive material disposed within each of said receptacles, said prongs being electrically connected to one another, each of said prongs being elongated and having a pointed end, each of said prongs extending generally longitudinally of its associated receptacle with said pointed end facing the entrance ino the associated receptacle, each of said prongs being disposed generally intermediate the peripheral walls of its associated receptacle; so as to be aligned with the wire in the associated cable when that cable is inserted into the associated receptacle, (b) disposing adhesive means within each of said receptacles, each of said adhesives means comprising a quantity of flowable air-drying adhesive material enclosed within a fracturable container, (c) for each receptacle, inserting one end of an electrical cable into said receptacle so as to imbed the associated prong end into the end of the cable to thereby establish physical and electrical contact and connection between the wire of the cable and the prong, (d) for each receptacle, effecting the fracture of the adhesive container between the cable and the connector so as to release the flowable adhesive material into the receptacle, and (e) allowing said adhesive in each receptacle to solidify so as to form a bond between the insulation of the two cables and the housing of the connector.

12. A method for connecting together in linear alignment a pair of electrical cables which each have at least one wire extending therethrough by the use of a compact electrical connector, said method comprising the steps of:

(a) providing an electrical connector having a housing of electrical insulating material defining a pair of elongated receptacles, each of said receptacles having an entrance and peripheral walls and being configured and proportioned for receipt therein of the end of an electrical cable which has exterior insulation and at least one electrical wire extending therethrough; said receptacles being generally aligned in end-to-end relation to one another with their respective entrances opening in opposite directions, said housing having an exterior surface which is not substantially larger in transverse cross-section than the transverse cross-section of the exterior surface of the cables; there being at least one prong of electrically conductive material disposed within each of said receptacles, said prongs being electrically connected to one another, each of said prongs being elongated and having a pointed end, each of said prongs extending generally longitudinally of its associated receptacle with said pointed end facing the entrance into the associated receptacle, each of said prongs being disposed generally intermediate the peripheral walls of its associated receptacle, so as to be aligned with the wire in the associated cable when that cable is inserted into the associated receptacle, (b) disposing adhesive means within each of said receptacles, each of said adhesive means comprising a quantity of flowable air-drying adhesive material enclosed within a fracturable container, (c) for each receptacle, inserting one end of an electrical cable into said receptacle with the wire of the cable aligned with the associated prong, (d) for each receptacle, advancing the end of the associated cable into the receptacle so as to fracture the associated adhesive container between that cable and the associated prong and release the flowable adhesive material in that container into the receptacle, and so as to imbed the associated prong end into the end of that cable to thereby establish physical and electrical contact and connection between the wire of the cable and the prong, and (e) allowing said adhesive in each receptacle to solidify so as to form a bond between the insulating material of the cables and the housing of the connector.

* * * * *